US007765937B2

(12) United States Patent
Weissenrieder et al.

(10) Patent No.: US 7,765,937 B2
(45) Date of Patent: Aug. 3, 2010

(54) TABLE SYSTEM

(75) Inventors: Tobias Weissenrieder, Lauchringen (DE); Klaus-Peter Grasse, Weilheim/Remetschwiel (DE); Alexander Tritschler, Waldshut (DE)

(73) Assignee: Sedus Stoll AG, Waldshut (DE)

( * ) Notice: Subject to any disclaimer, the term of this patent is extended or adjusted under 35 U.S.C. 154(b) by 446 days.

(21) Appl. No.: 11/745,802

(22) Filed: May 8, 2007

(65) Prior Publication Data

US 2007/0261614 A1 Nov. 15, 2007

(30) Foreign Application Priority Data

May 9, 2006 (DE) ..... 10 2006 021 480

(51) Int. Cl.
*A47B 37/00* (2006.01)

(52) U.S. Cl. ..... 108/50.02; 108/143; 108/64; 248/188

(58) Field of Classification Search ..... 108/154, 108/155, 157.16, 159.11, 158.13, 153.1, 108/157.1, 143, 102, 50.01, 50.02; 248/188, 248/188.1, 188.4
See application file for complete search history.

(56) References Cited

U.S. PATENT DOCUMENTS 3,960,352 A * 6/1976 Plattner et al. ..... 248/188
4,130,070 A * 12/1978 Herrin ..... 108/143
4,748,913 A * 6/1988 Favaretto et al. ..... 108/50.02
4,838,177 A * 6/1989 Vander Park ..... 108/50.02
4,838,181 A * 6/1989 Luyk ..... 108/143
4,944,235 A * 7/1990 Jahnke et al. ..... 108/154
5,549,055 A * 8/1996 Kusch ..... 108/159.11
5,681,116 A * 10/1997 Lin ..... 384/42
5,947,035 A * 9/1999 Chang ..... 108/143
6,712,009 B2 3/2004 Buntru et al.
6,725,784 B2 * 4/2004 Crinion ..... 108/50.01
6,997,114 B2 * 2/2006 Chang ..... 108/64
7,111,564 B2 * 9/2006 Chang ..... 108/155
2005/0263042 A1 * 12/2005 Martin et al. ..... 108/50.02

(Continued)

FOREIGN PATENT DOCUMENTS

DE 44 02 520 C1 7/1995

(Continued)

OTHER PUBLICATIONS

"Personal Desks", Sedus talk about, 6 pages.

*Primary Examiner*—José V Chen
(74) *Attorney, Agent, or Firm*—Oblon, Spivak, McClelland, Maier & Neustadt, L.L.P.

(57) ABSTRACT

A table system including at least one primary module and at least two secondary modules. The primary module includes a tabletop plate and a plurality of crossbars disposed parallel to each other and secured to the underside of the tabletop plate. A secondary module comprises a table leg having an upper end and a plurality of interlocking and bracing mechanisms disposed at the upper end of the table leg. A primary module and a secondary module together have an attached state and an interconnected state. The interlocking and bracing mechanisms have an open state and a closed state. In the attached state, each interlocking and bracing mechanism is in the open state, and is achieved by vertically setting the primary module onto the secondary module. In the interconnected state, each interlocking and bracing mechanism is in the closed state, interlocked independently into the interior portion of a crossbar.

9 Claims, 13 Drawing Sheets

U.S. PATENT DOCUMENTS

2006/0096506 A1* 5/2006 Brauning et al. ..... 108/50.02

FOREIGN PATENT DOCUMENTS

DE 299 14 651 U1 12/1999
DE 100 49 853 A1 4/2002
DE 101 62 863 A1 7/2003
DE 20 2005 011 053 U1 12/2005
FR 2 805 866 A1 9/2001

* cited by examiner

TABLE SYSTEM

TECHNICAL FIELD

The present invention relates to the field of the furniture industry. It pertains to a table system that is suitable for creating stand-alone tables as well as table systems that can be interlinked in any length.

PRIOR ART

On the one hand, tables comprising only one integral unit and constituting a rigid structure are known. Such tables have table legs that are mounted on a tabletop plate and fixed at a specific position. The disadvantage of these tables is that they cannot be dismantled or reconfigured.

On the other hand, tables are known in which table legs having a fixed position can be collapsed in order to transport the tables or store them in a space-saving manner. These collapsible table legs can be designed, for example, as four individual legs per table or as an integral base (T-base). For example, due to its design, a known folding table has a high, continuous groove in which a T-shaped steel tube frame is immersed. From DE 100 49 853 A1, a folding table is known comprising a tabletop plate and a collapsible steel wire frame with four vertical struts and four cross struts, in which with a comparatively thin steel wire, a statically advantageous triangular structure of forces is realized, which enables a stable table frame despite two loose joint areas.

It is also known that stand-alone tables can be linked to form table systems that are used as conference or meeting table systems. To this end, stand-alone tables or individual tabletop plates are assembled in rows or other arrangements, such as a U shape, wherein disadvantageously, however, additional special components are required as fixing and locking devices or specially made tabletop plates are required. Thus, for example, in the present applicant's "talk about" product series, a quick linkage of stand-alone tables is accomplished with a separately produced plastic clip, which is clipped onto and thus connects two adjacent stand-alone tables. Another linking option for the "talk about" product series consists of interconnecting the stand-alone tables by means of special intermediate plates.

The disadvantage of the known prior art is that in order to link the stand-alone tables, additional components are required, such that the operation of the fixing and locking devices is relatively cumbersome, and the level of effort required for assembly and the rate of material usage are relatively high.

DISCLOSURE OF THE INVENTION

The present invention attempts to eliminate the cited disadvantages of the prior art. It is the object of the invention to develop a table system that can be used as a conference and training table system for table systems as well as for stand-alone tables and is characterized by reduced material usage and easy operation. In addition, it should be possible to integrate network solutions and communication technologies into the tabletop plates without difficulty.

According to the invention, this is achieved with a table system according to the preamble to claim 1 in that the table system comprises two distinct modules, wherein a primary module includes the tabletop plate and two crossbars interspaced with respect to each other and securely arranged on the underside of the table, and wherein a secondary module includes the table leg with at least two interlocking and bracing mechanisms, wherein at least one of the interlocking and bracing mechanisms of the secondary module engages in each case into one of the crossbars of the primary module, and said interlocking and bracing mechanism operates according to the knuckle joint principle.

The advantages of the present invention consist of the fact that the table system according to the invention can be manufactured and operated very easily and inexpensively. Additional components are not required. Moreover, the table legs can be installed and positioned freely along the entire length of the table. Advantageously, a tool is not required; rather, one only needs to operate the bracing mechanism on the table leg.

It is appropriate if, in order to form a stand-alone table, one primary module and two secondary modules are interconnected, whereas to form a table system, n primary modules and (n+1) secondary modules are interconnected, wherein $n \geqq 2$ and n are whole numbers. Stand-alone tables can be created, as well as table systems that are linked in any number of lengths.

Furthermore, it is advantageous if, in table systems, (n−1) of the secondary modules are arranged centrally in each case between adjacent primary modules. In this way, the number of required table legs can be reduced. Thus, it is possible, for example, to connect two tabletop plates with only 3 table legs. Even corner linkages, for example, in the shape of an "L" or a "U", can be configured quickly and without difficulty.

Moreover, it is advantageous if the secondary module is designed as a central-crossbar T-base, on the upper end of which is arranged a plate into which the interlocking and bracing mechanism is integrated. This mechanism operates according to the knuckle joint principle and comprises a comparatively long pivoted handle, which is articulated with a smaller clamping piece exhibiting a detent lug by means of a connecting piece attached on two sides, wherein in the closed state, the handle is arranged horizontally in the plate and thereby forms a plane with the plate, and the clamping piece is anchored in the profile of the crossbar, whereas in the open state, the handle is arranged perpendicularly to the plate, and the clamping piece with the detent lug can be latched into a recess provided for this purpose on the upper part of the plate. The closure at the handle requires little force to operate. At the same time, however, a very strong force is generated at the clamping piece. This strong closing force and the fact that an autonomous opening of the mechanism is 100% precluded make this table system according to the invention secure and user-friendly. The latching of the clamping piece into the plate ensures that an unintentional, autonomous closing is prevented when the bracing mechanism is opened. This bracing mechanism is simple and insusceptible to malfunction.

Advantageously, the form of the crossbars can be designed very simply, in a "U" shape, for example, and it can be easily bolted on the underside of the table. Thus, the manufacturing and assembly costs are very low.

BRIEF DESCRIPTION OF THE DRAWINGS

Several exemplary embodiments of the invention are depicted in the drawing. Shown are.

Only those elements essential for understanding the invention are shown. Identical elements are provided with identical reference numbers.

EXECUTION OF THE INVENTION

The invention is explained in further detail below on the basis of several exemplary embodiments and FIGS. 1 through 13.

Figure 1:
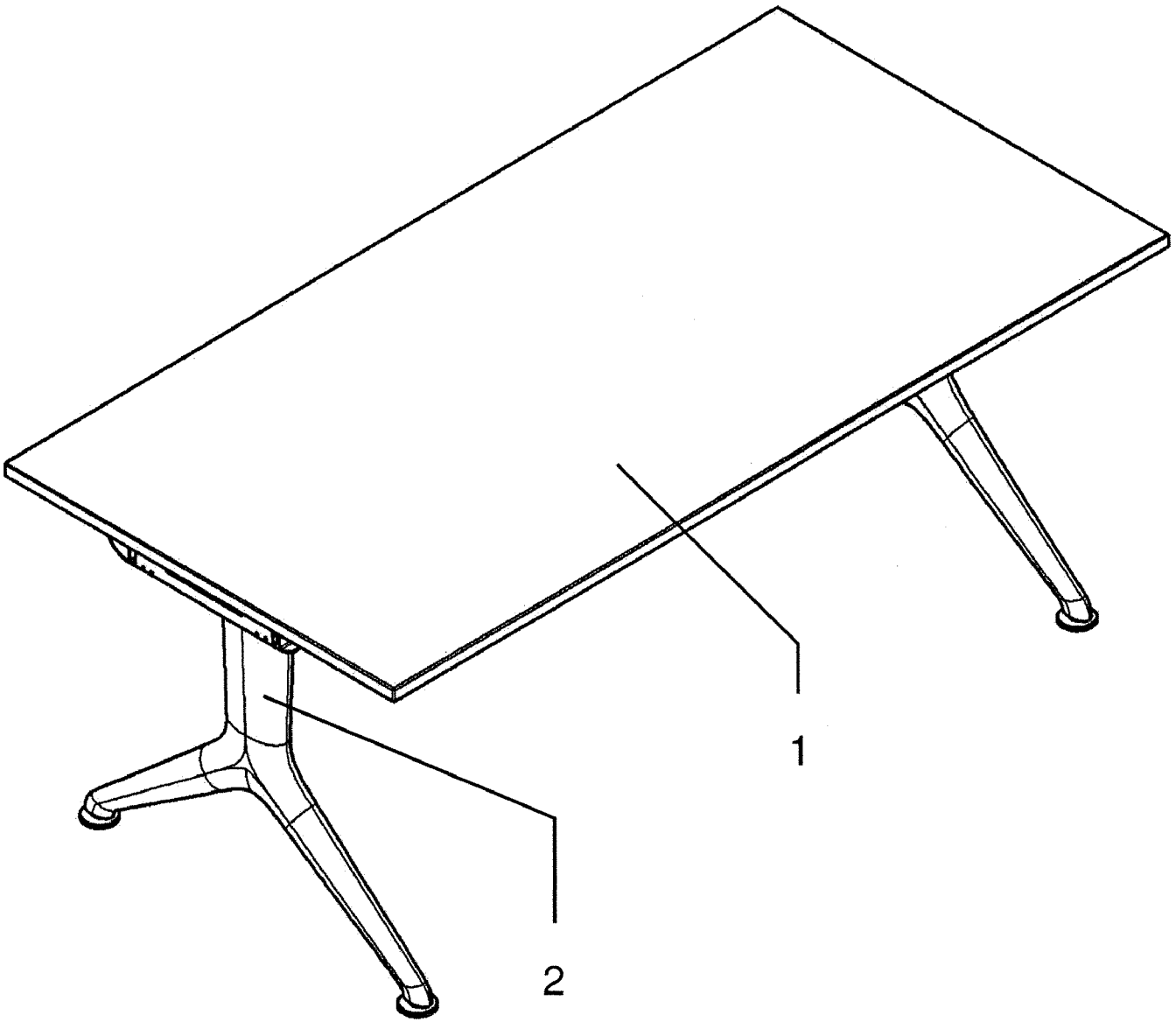
FIG. 1 A perspective view of a stand-alone table according to the invention from above.
Figure 2:
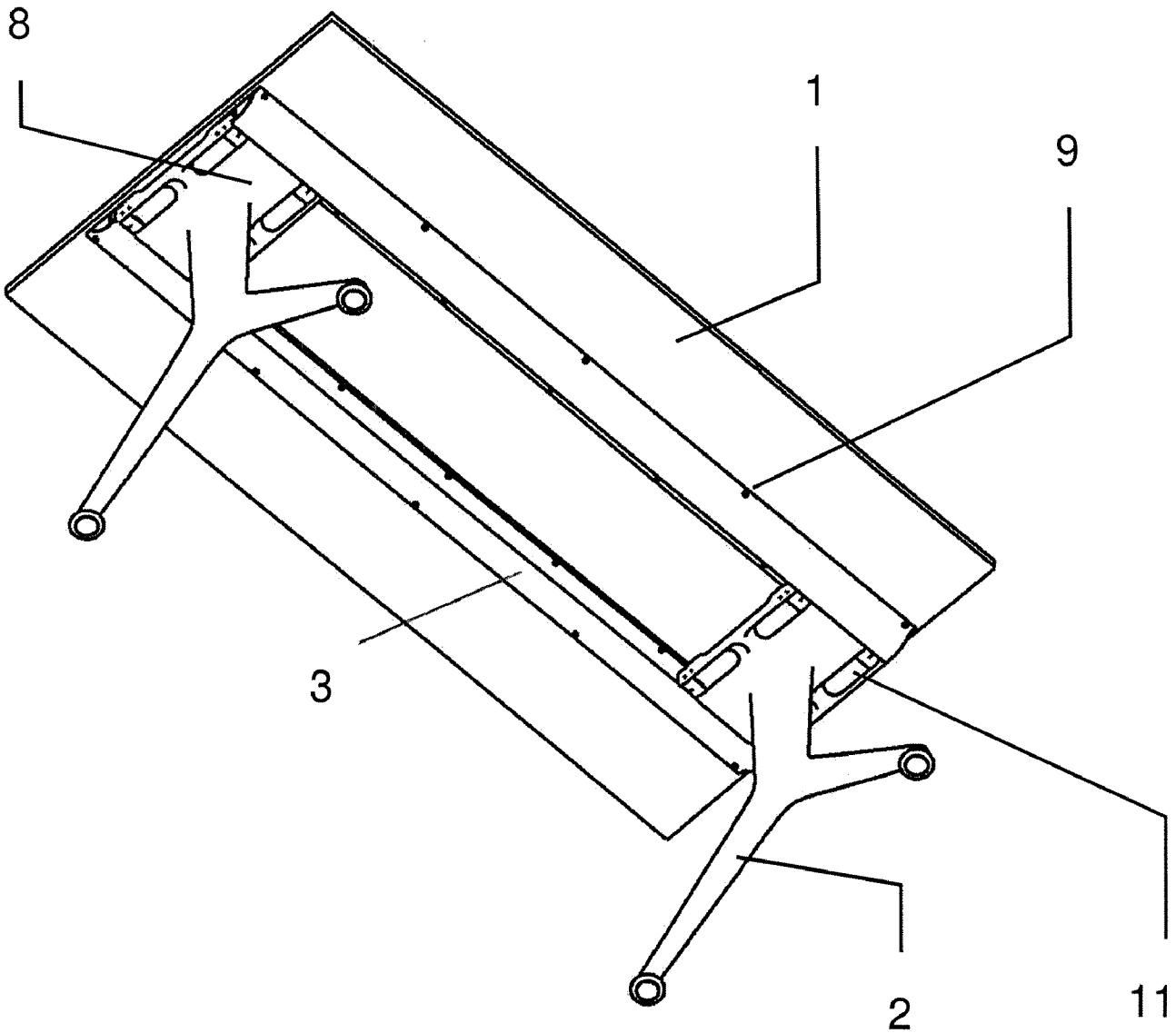
FIG. 2 A perspective view of a stand-alone table according to the invention from below.
Figure 3:
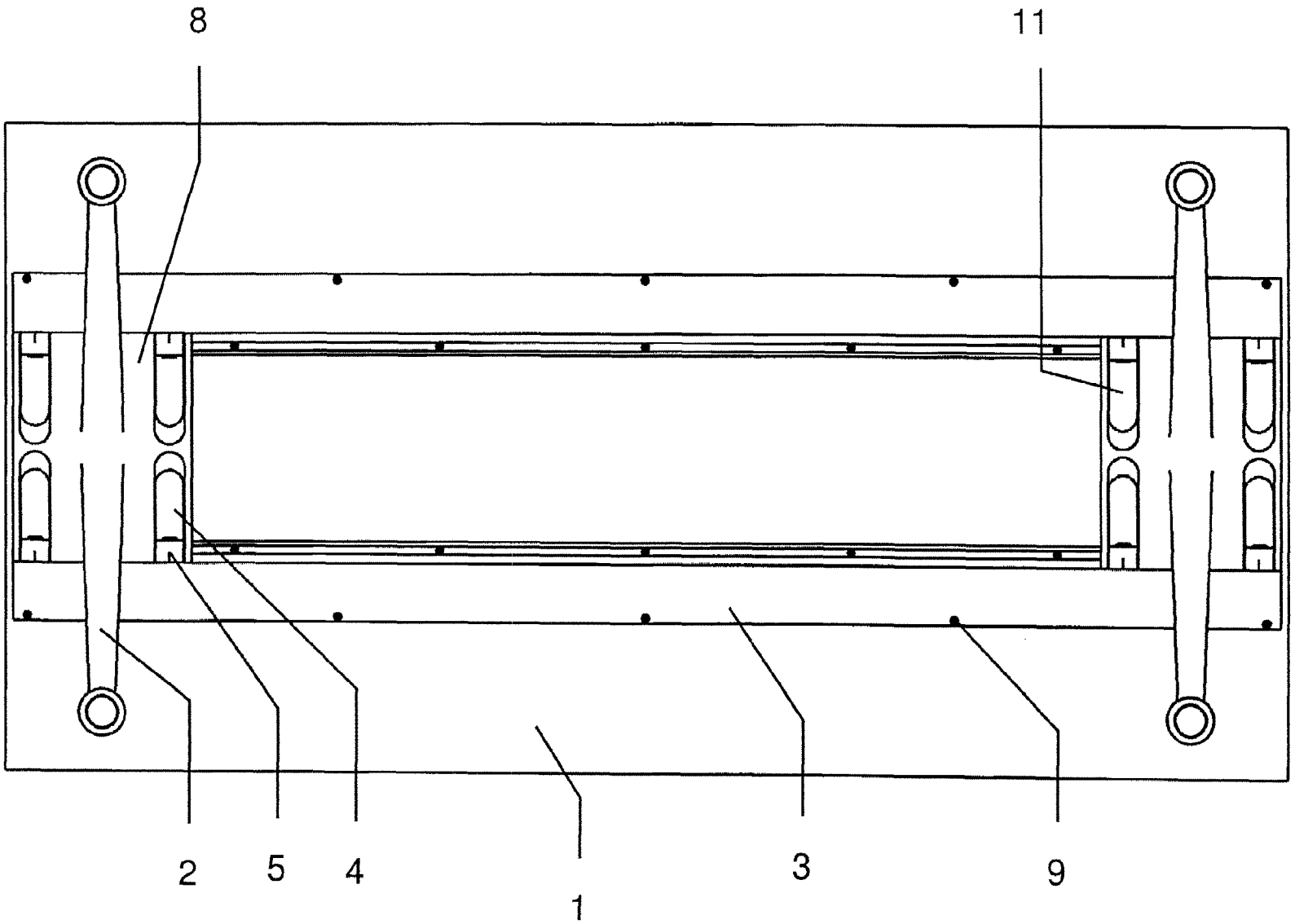
FIG. 3 A plan view of a stand-alone table according to the invention from below.

A first exemplary embodiment is represented in FIGS. 1 through 3.

FIG. 1 shows a perspective view of a stand-alone table according to the invention from above, FIG. 2 shows this stand-alone table from below, and FIG. 3 shows the plan view from above. According to the invention, the stand-alone table comprises two distinct modules. The primary module is formed by the tabletop plate 1 and two crossbars 3 interspaced with respect to each other and securely arranged on the underside of the table. The crossbars 3 are securely attached to the underside of the table (FIG. 2, FIG. 3) by means of bolts 9. The secondary module comprises the table leg 2 with interlocking and bracing mechanisms 11. Two secondary modules are present in this exemplary embodiment. Four interlocking and bracing mechanisms 11 are present per table leg 2, wherein two of these engage in each case into one of the crossbars 3 of the primary module. The handle 4 and the clamping piece 5 of the mechanisms 11 can be clearly recognized in FIG. 3. Each table leg 2 is designed as a central-crossbar T-base, on the upper end of which is arranged a horizontal plate 8 into which the interlocking and bracing mechanisms 11 are integrated. The plate 8 extends from one crossbar 3 to the other crossbar 3. According to the invention, the interlocking and bracing mechanism 11 operates according to the knuckle joint principle, which is described below.

Figure 4:
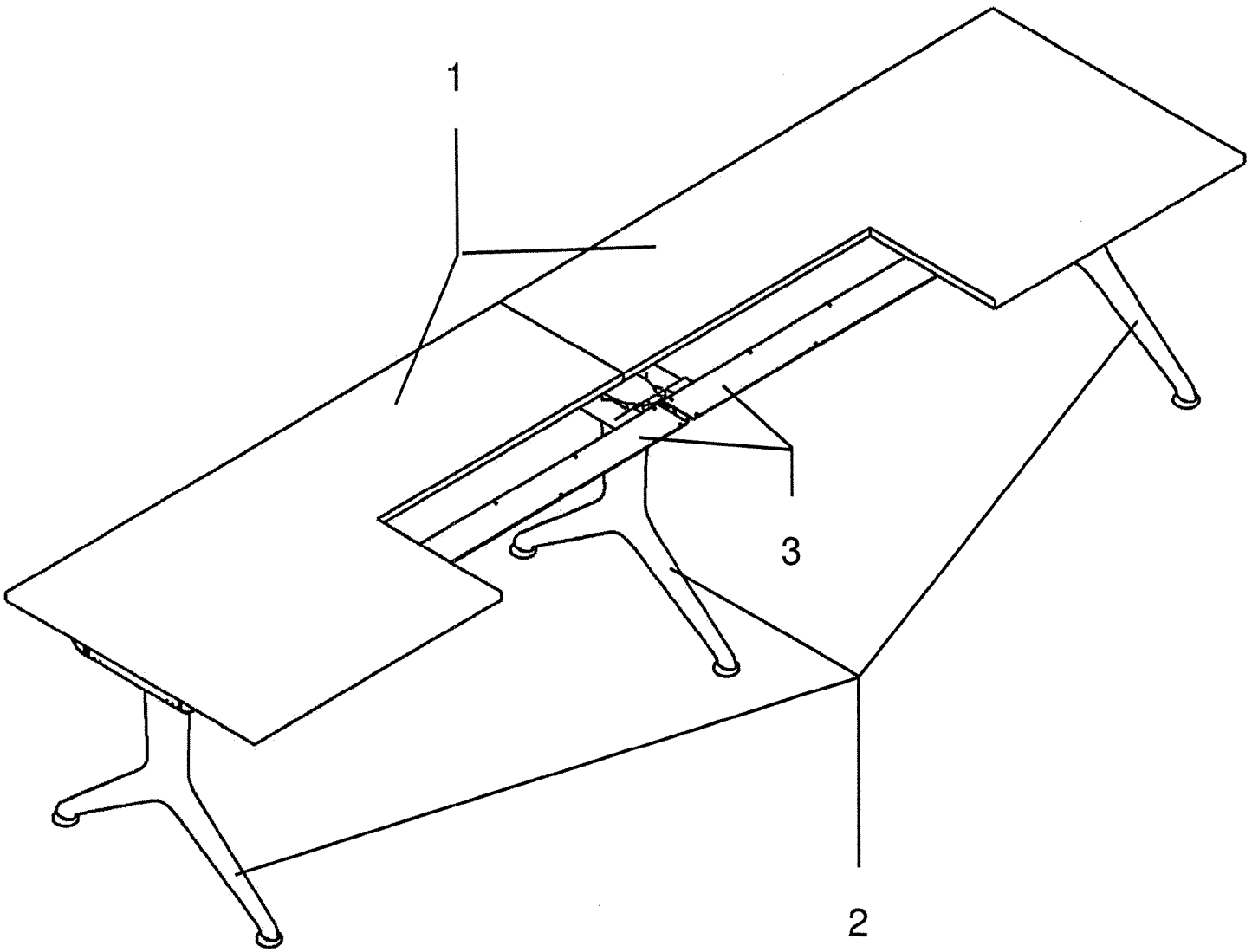
FIG. 4 A perspective view of a table system according to the invention with two linked tables from above, wherein a part of the tabletop plates is not shown in the midsection.
Figure 5:
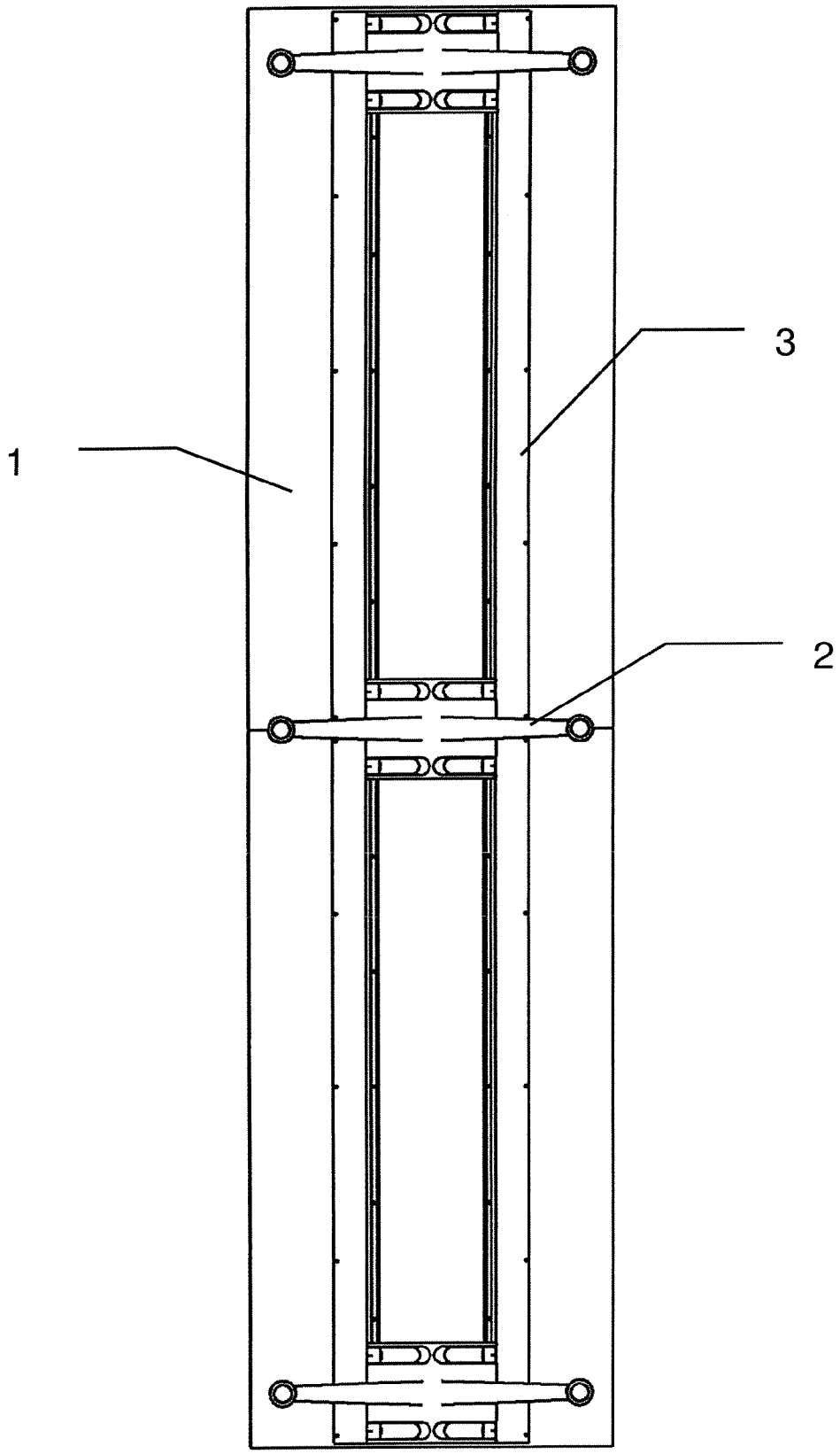
FIG. 5 A plan view of a table system according to the invention with two linked tables from below.
Figure 6:
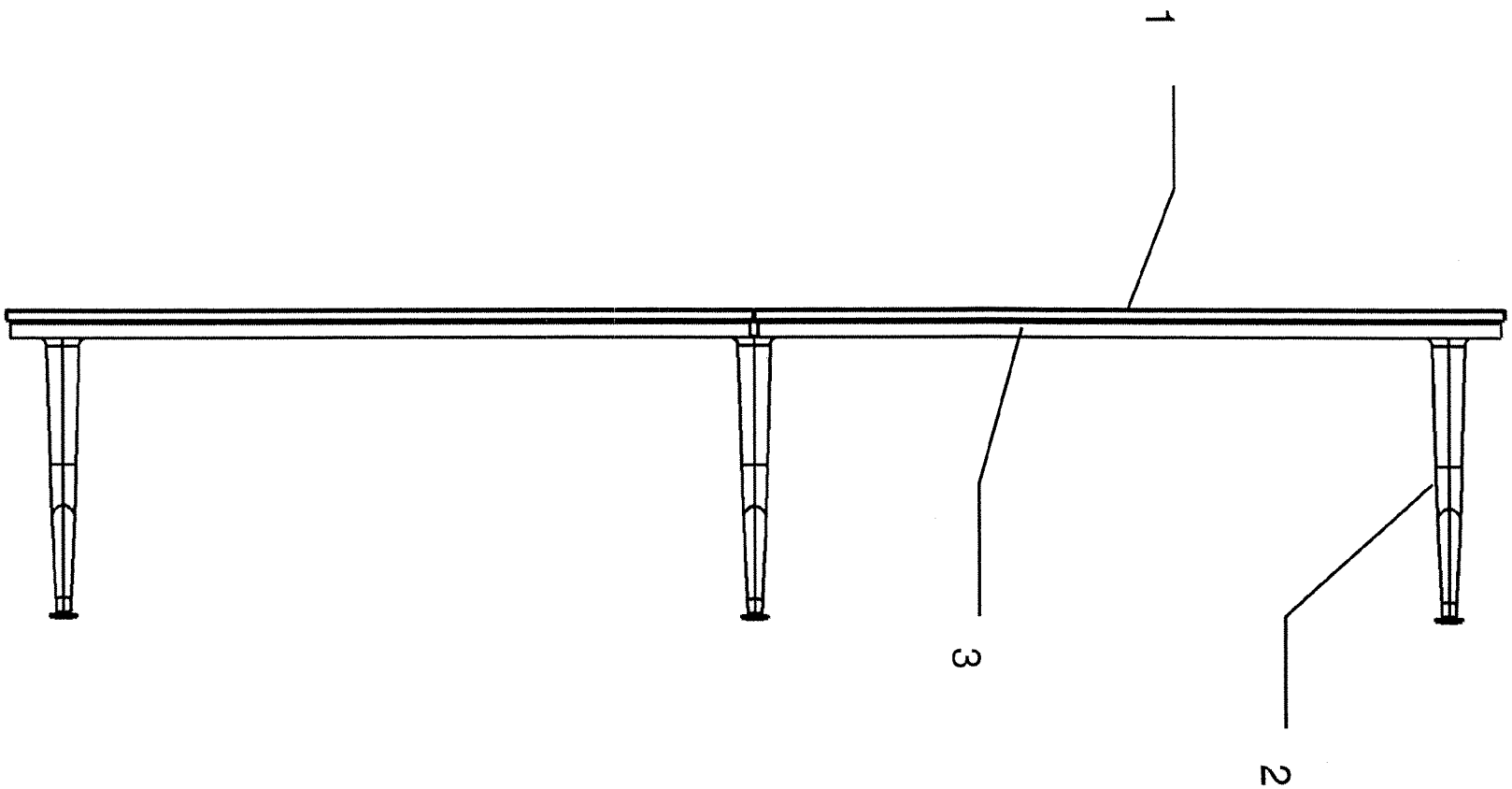
FIG. 6 A side view of FIG. 5.

A second exemplary embodiment of the table system according to the invention is represented in FIGS. 4 through 6. FIG. 4 shows a perspective view of a table system according to the invention with two linked tables from above, wherein a part of the tabletop plates is not shown in the midsection. FIG. 5 shows a plan view and FIG. 6 a side view of FIG. 4. Here, it is clearly recognizable that only three secondary components (table legs) are required for this table system comprising two linked tables. One table leg 2 is always positioned centrally between two adjacent tabletop plates 1. It is generally valid that for the purpose of forming a table system linked in series or in a corner-linkage configuration, n primary modules and (n+1) secondary modules are interconnected, wherein $n \geqq 2$ and n are whole numbers, and that (n−1) of the secondary modules are arranged centrally in each case between adjacent primary modules.

The connection between the tabletop plate 1 and the table leg 2 is achieved with a precisely fitted—but simple and insusceptible to malfunction—interlocking and bracing mechanism, for which FIGS. 7 through 11 are intended to provide further elucidation.

Figure 7:
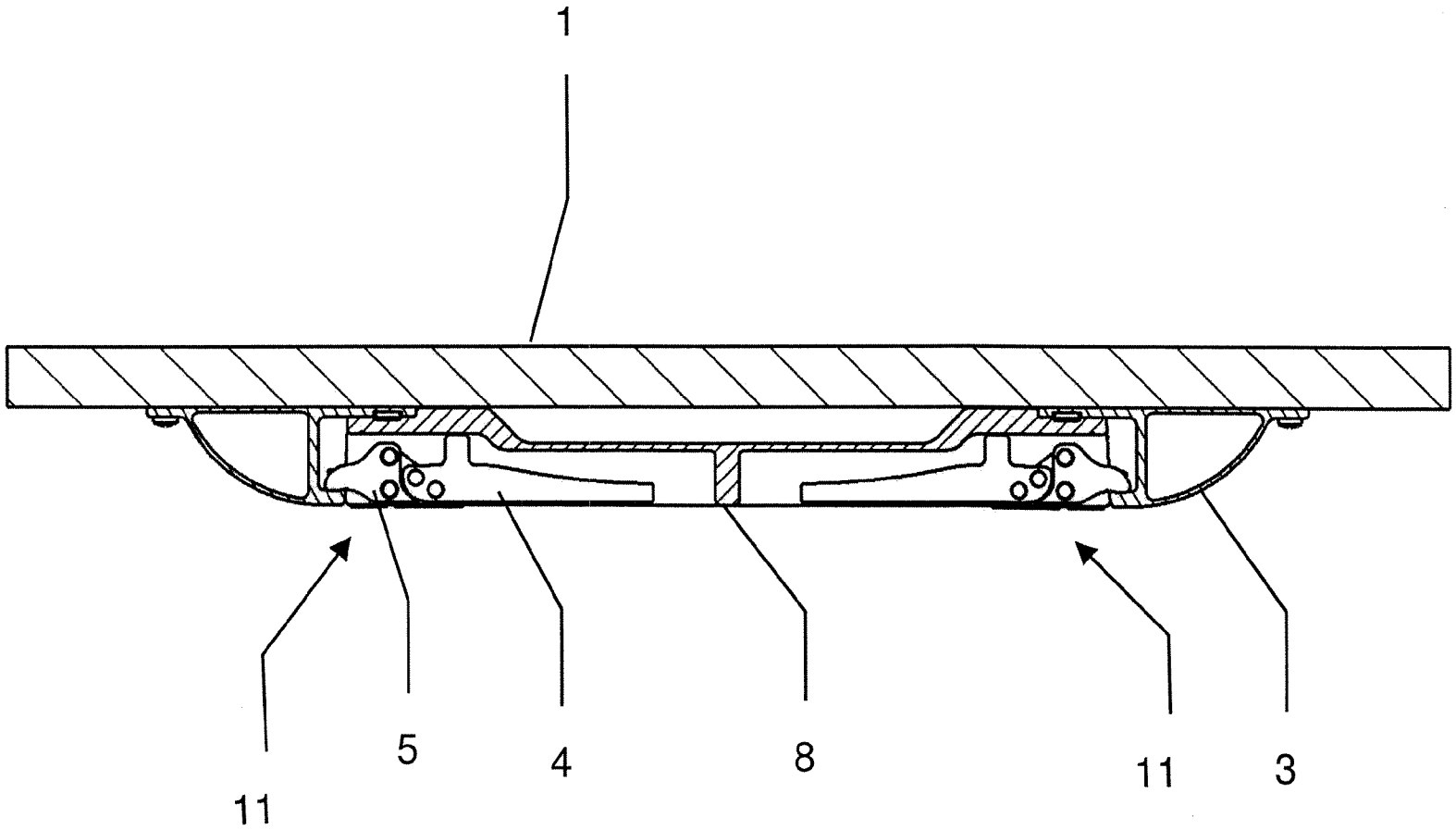
FIG. 7 A sectional view through the tabletop plate in the region of the interlocking and bracing mechanism (closed state)
Figure 8:
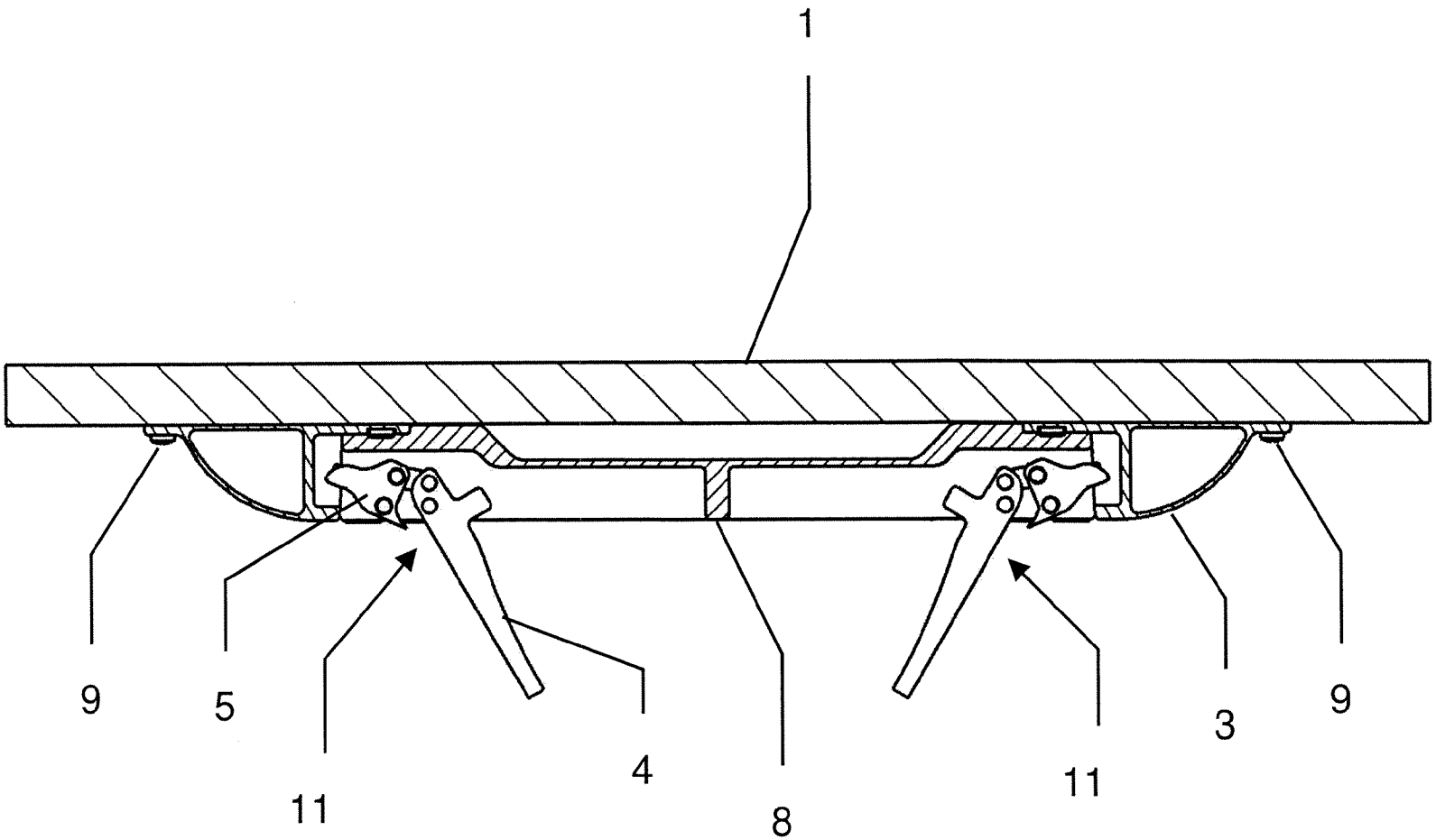
FIG. 8 A sectional view through the tabletop plate in the region of the interlocking and bracing mechanism (half-opened state)
Figure 9:
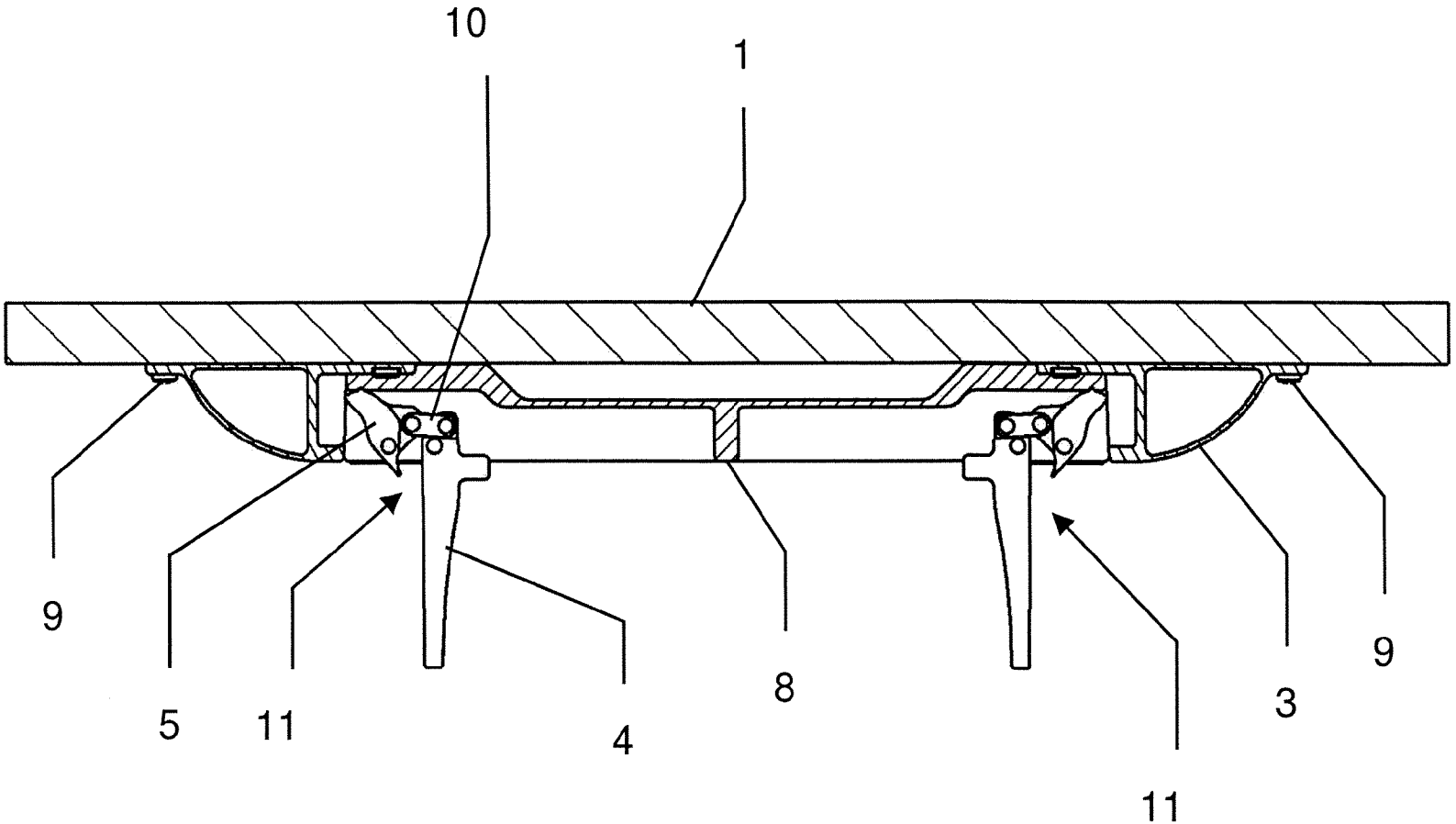
FIG. 9 A sectional view through the tabletop plate in the region of the interlocking and bracing mechanism (opened state)
Figure 10:
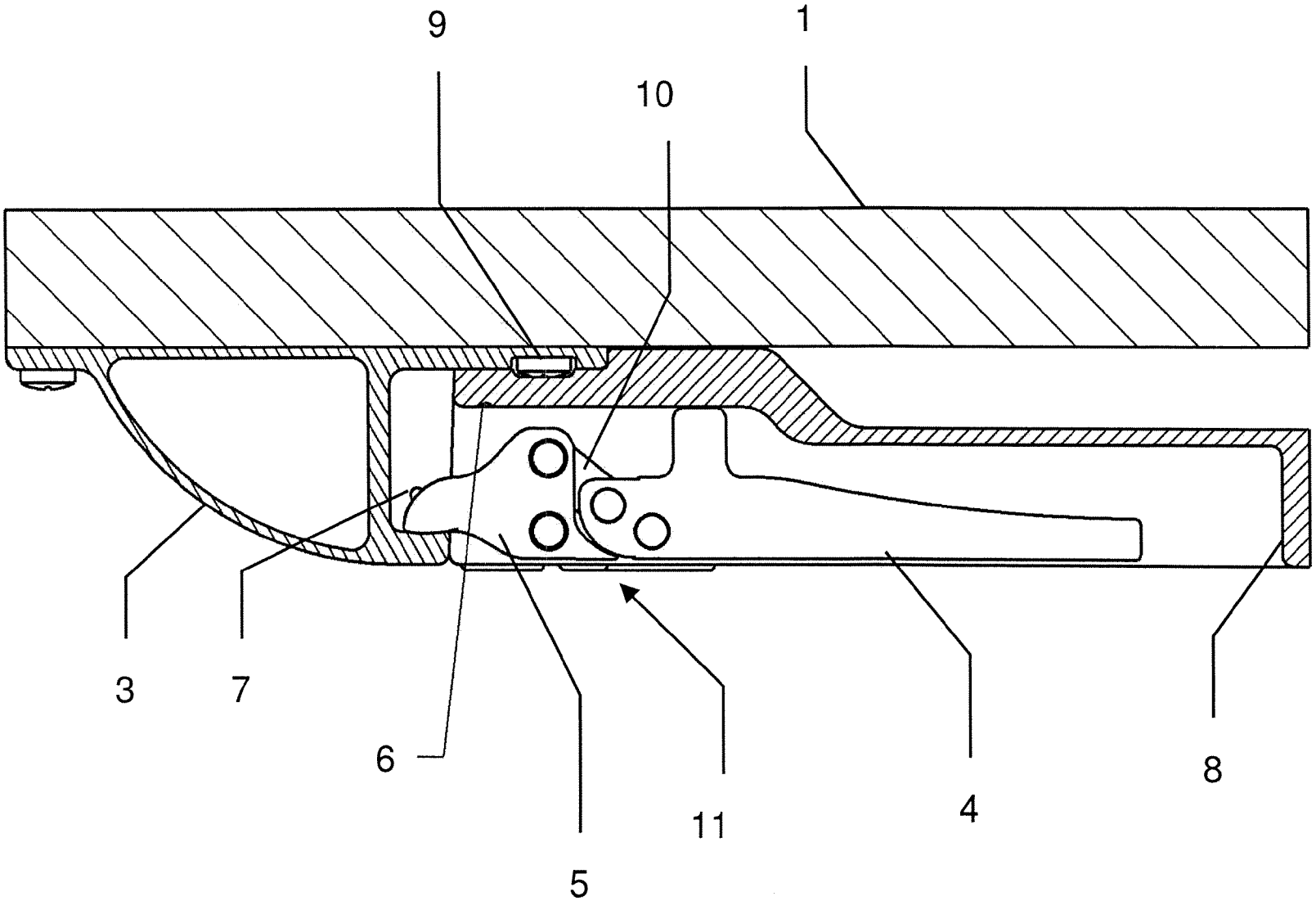
FIG. 10 An enlarged representation of FIG. 7.
Figure 11:
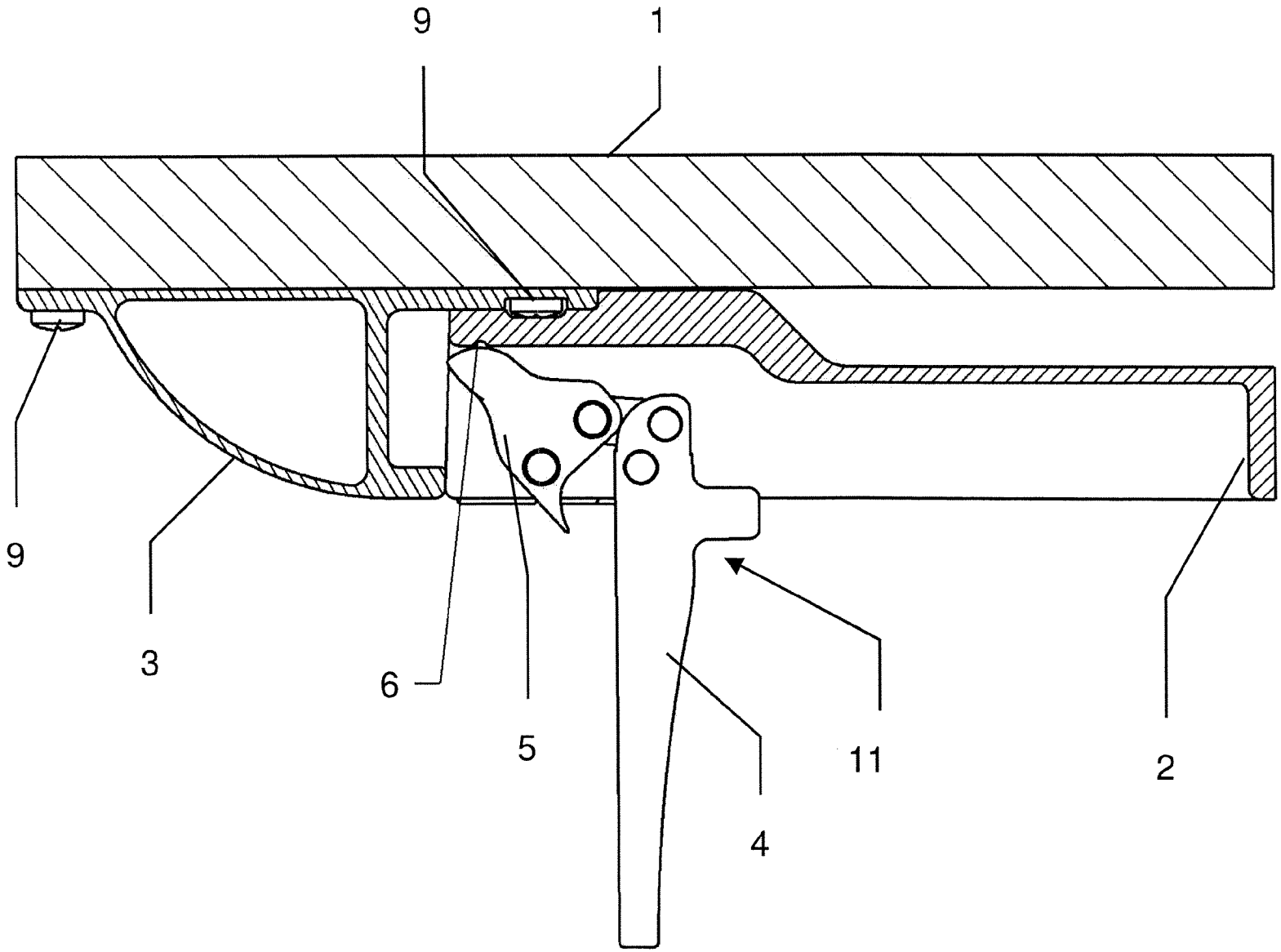
FIG. 11 An enlarged representation of FIG. 9.

FIG. 7 shows a sectional view through the tabletop plate 1 in the region of the interlocking and bracing mechanism 11 in the closed state, whereas FIG. 8 shows a corresponding sectional view in the half-opened state, and FIG. 9 shows this sectional view in the completely open state. FIG. 10 is an enlarged cutout of FIG. 7. FIG. 11 is an enlarged cutout of FIG. 9.

The interlocking and bracing mechanisms 11 are integrated into the plate 8 of the table leg 2. Each of these mechanisms 11 features a comparatively long pivoted handle 4, which is articulated with a smaller clamping piece 5 exhibiting a detent lug by means of a connecting piece 10 attached on two sides. In the closed state (FIG. 7, FIG. 10), the handle 4 is arranged horizontally in the plate 8 and thereby forms a plane with the underside of the plate 8. The clamping piece 5 is anchored in the profile of the crossbar 3. In the open state (FIG. 9, FIG. 11), the handle 4 is arranged perpendicularly to the plate 8, and the clamping piece 5 is latched with the detent lug 7 in a recess 6 provided for this purpose on the upper part of the plate 8.

With a large motional action—the pivoting of the handle 4—a small motional action is generated in the clamping piece 5. The long motional action when operating the handle 4 can be clearly perceived by the user, and he therefore knows that he is moving the mechanism. The distinctly smaller motion of the clamping piece 5 has a positive effect on the required overall height, i.e., it can be kept low, given that the crossbar 3 and the plate 8 of the table leg 2 need only exhibit a low height.

The form of the crossbar 3 can be very simple; only a "U" shape is necessary. The mechanism 11 is completely integrated into the plate 8 of the table leg 2 and forms a closed plane with the plate 8, which can be a flange plate, for example.

Operation of the closure at the handle 4 requires only a small expenditure of force, but at the same time, a very large force is generated at the clamping piece 5. This strong closing force and the fact that an autonomous opening of the mechanism is 100% precluded make this system secure and user-friendly. The latching of the clamping piece 5 into the recess 6 of the plate 8 (see FIG. 11) when the mechanism 11 is opened ensures that an autonomous, unintentional closing does not occur. With the proposed design, the interlocking is concentrated from the outside toward the inside onto a table-leg platform. The T-base can be manufactured economically in a plastic version.

Figure 12:
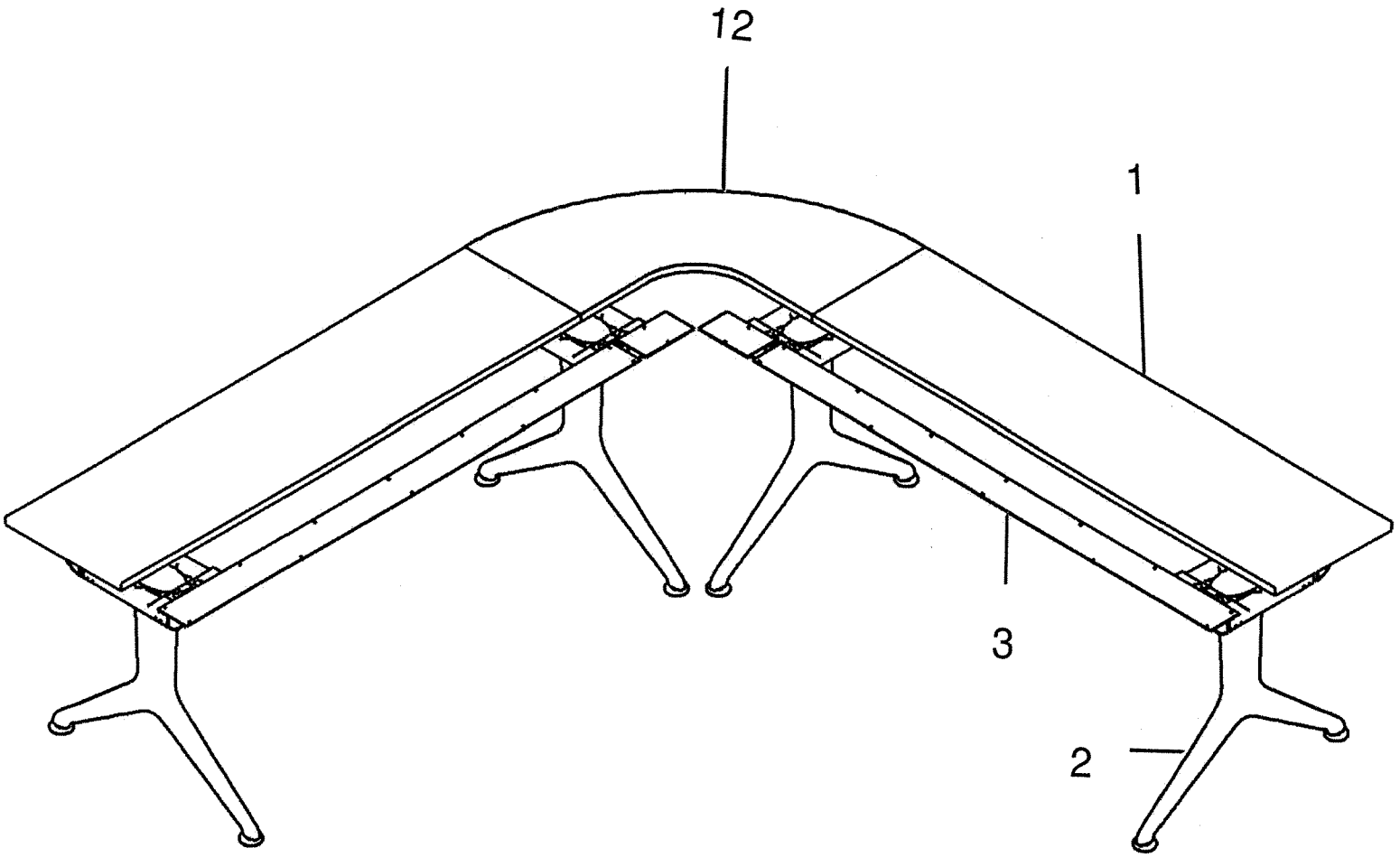
FIG. 12 A perspective view of a table system in an "L" shape (corner linkage) from above, wherein only half of the tabletop plates are shown for the purpose of clarity and FIG. 13 A plan view of the solution according to the invention corresponding to FIG. 12 from below.
Figure 13:
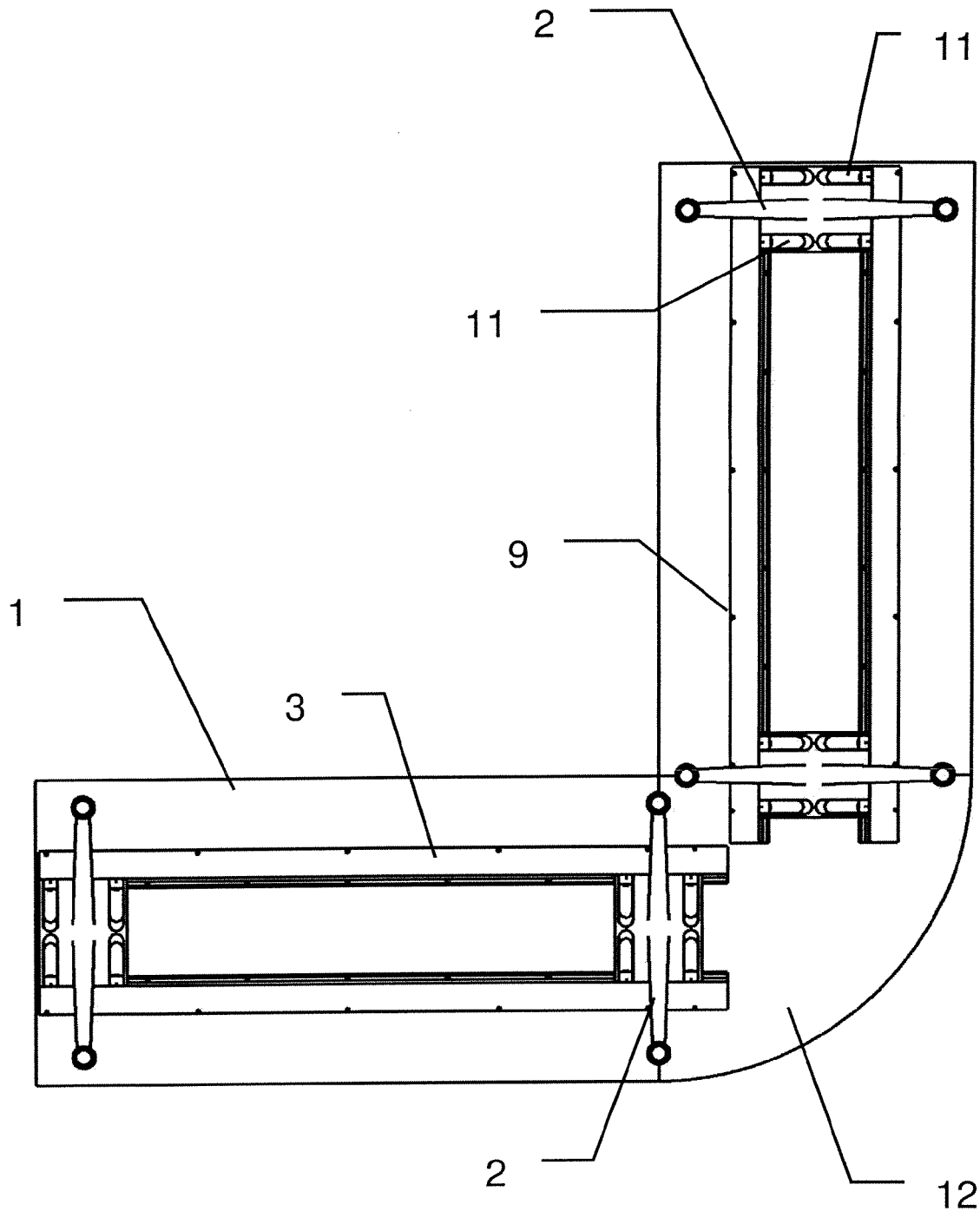

An additional exemplary embodiment is represented in FIGS. 12 and 13. FIG. 12 shows a perspective representation of a table system in an "L" shape (corner linkage) from above, wherein for the purpose of clarity, only half of the tabletop plates are shown, and FIG. 13 shows a corresponding plan view from below. Only one 90° segment plate with crossbars 3 secured on the underside is required to produce this corner linkage.

Network solutions and communication technologies can be integrated without difficulty into the tabletop plates 1 by means of the crossbars 3.

Of course, the invention is not restricted to the described exemplary embodiments. For example, circular crossbars 3 are also conceivable or the plates 8 can also be intended for use as adapter plates for a stand-alone table leg 2. Additional adapter pieces can establish the connection to variously shaped crossbars 3.

REFERENCE NUMBER LIST

1 Tabletop plate
2 Table leg
3 Crossbar
4 Handle
5 Clamping piece
6 Recess
7 Detent lug
8 Plate
9 Bolt
10 Connecting piece
11 Interlocking and bracing unit
12 90° segment plate

The invention claimed is:

1. A table system, comprising:

at least one primary module including, a tabletop plate having an underside, and a plurality of crossbars, disposed parallel to each other and secured to the underside of the tabletop plate; and at least two secondary modules, each of the secondary modules including, a table leg having an upper end, and a plurality of interlocking and bracing mechanisms disposed at the upper end of the table leg;

wherein one primary module and one secondary module together have an attached state and an interconnected state, wherein each of the interlocking and bracing mechanisms has an open state and a closed state, wherein, in the open state of the interlocking and bracing mechanisms, the primary module can be attached to the secondary module, thereby reaching the attached state, in which the upper part of the table leg is aligned perpendicularly to the underside of the tabletop plate, wherein the interconnected state is reached from the attached state by changing the interlocking and bracing mechanisms from the open state to the closed state, and wherein, in the interconnected state, the primary module is securely interconnected with the secondary module and each of the crossbars has at least one interlocking and bracing mechanism interlocked into an interior portion of the crossbar, wherein the interlocking and bracing mechanisms are secured to a plate disposed on the upper end of the table leg, and the interlocking and bracing mechanisms include:

a handle pivotally connected to the plate;

a connecting piece including a first end and a second end, the first end being rotatably connected to the handle; and a clamping piece, the clamping piece including an upper pivot point rotatably connected to the second end of the connecting piece, a lower pivot point pivotally attached to the plate, and a detent lug disposed on a surface of the clamping piece;

wherein, in the closed state, a plane formed along a longitudinal direction of a length of the handle is substantially parallel to the underside of the tabletop plate and the clamping piece is interlocked in the crossbar, and wherein, in the open state, the plane formed along the length of the handle is substantially perpendicular to the underside of the tabletop plate and the detent lug is latched into a recess formed in an upper portion of the plate.

2. The table system according to claim 1, wherein one primary module is connected to two secondary modules, whereby a single stand-alone table is formed.

3. The table system according to claim 1, wherein two primary modules are disposed adjacent to each other, such that the underside of each tabletop plate is on a same plane, and a third secondary module in the closed state adjoins the two primary modules, whereby the primary modules are connected in series.

4. The table system according to one of claims 1-3, wherein the secondary module is shaped as a central-crossbar T-base.

5. The table system according to claim 1, wherein the crossbars form a U-shaped profile.

6. The table system according to claim 1, wherein the crossbars are secured to the underside of the tabletop plate by bolts.

7. The table system according to claim 1, wherein the crossbars form a U-shaped profile and are disposed such that an outer surface of a side of the U-shaped profile is parallel to a plane defined by the underside of the tabletop plate.

8. The table system according to claim 1, wherein four interlocking and bracing mechanisms are provided on each secondary module, disposed such that a first pair of the interlocking and bracing mechanisms engage a first crossbar and a second pair of interlocking and bracing mechanisms engage a second crossbar.

9. A table system, comprising:

at least one primary module including, a tabletop plate having an underside, and a plurality of crossbars, disposed parallel to each other and secured to the underside of the tabletop plate; and at least two secondary modules, each of the secondary modules including, a table leg having an upper end, and a plurality of interlocking and bracing mechanisms disposed at the upper end of the table leg;

wherein one primary module and one secondary module together have an attached state and an interconnected state, wherein each of the interlocking and bracing mechanisms has an open state and a closed state, wherein, in the open state of the interlocking and bracing mechanisms, the primary module can be attached to the secondary module, thereby reaching the attached state, in which the upper part of the table leg is aligned perpendicularly to the underside of the tabletop plate, wherein the interconnected state is reached from the attached state by changing the interlocking and bracing mechanisms from the open state to the closed state, wherein, in the interconnected state, the primary module is securely interconnected with the secondary module and each of the crossbars has at least one interlocking and bracing mechanism interlocked into an interior portion of the crossbar, wherein the interlocking and bracing mechanisms are secured to a plate disposed on the upper end of the table leg, and the interlocking and bracing mechanisms further include:

a handle pivotally connected to the plate;

a connection piece including a first and a second end, the first end being rotatably connected to the handle; and a clamping piece, the clamping piece including an upper pivot point rotatably connected to the second end of the connecting piece, a lower pivot point pivotally attached to the plate, and wherein, in the closed state, a plane formed along a longitudinal direction of a length of the handle is substantially parallel to the underside of the tabletop plate and the clamping piece is interlocked in the crossbar, and wherein, in the open state, the plane formed along the length of the handle is substantially perpendicular to the underside of the tabletop plate.

* * * * *